US009080281B2

(12) United States Patent
Earley, III

(10) Patent No.: US 9,080,281 B2
(45) Date of Patent: Jul. 14, 2015

(54) FABRIC PIN

(75) Inventor: Charles Marion Earley, III, Winterport, ME (US)

(73) Assignee: Eklipse, LLC, Winterport, ME (US)

( * ) Notice: Subject to any disclaimer, the term of this patent is extended or adjusted under 35 U.S.C. 154(b) by 0 days.

(21) Appl. No.: 13/991,845

(22) PCT Filed: Dec. 1, 2011

(86) PCT No.: PCT/US2011/062818

§ 371 (c)(1),
(2), (4) Date: Jul. 22, 2013

(87) PCT Pub. No.: WO2012/094073

PCT Pub. Date: Jul. 12, 2012

(65) Prior Publication Data

US 2013/0291352 A1 Nov. 7, 2013

Related U.S. Application Data

(60) Provisional application No. 61/421,987, filed on Dec. 10, 2010.

(51) Int. Cl.
*D06F 55/02* (2006.01)
*D06F 55/00* (2006.01)

(52) U.S. Cl.
CPC ..... *D06F 55/02* (2013.01); *D06F 55/00* (2013.01); *Y10T 24/44769* (2015.01)

(58) Field of Classification Search
CPC ..... D06F 55/00; D06F 55/02; F16B 2/22; Y10T 24/44769; F16L 3/12; F16L 3/13; B42F 1/10
USPC ..... 24/562, 67.9, 545, 560
See application file for complete search history.

(56) References Cited

U.S. PATENT DOCUMENTS 764,719 A * 7/1904 Gorton ..... 24/547
1,250,308 A * 12/1917 Hanson ..... 24/556

(Continued)

FOREIGN PATENT DOCUMENTS

CH 86018 8/1920
EP 0543787 A1 5/1993

(Continued)

OTHER PUBLICATIONS

"Notification of Transmittal of the International Search Report and the Written Opinion of the International Searching Authority, or the Declaration" received in International Application No. PCT/US2011/062818 dated May 7, 2012 (13 pages).
Current Claims of PCT/US2011/062818 dated May 2012 (3 pages).

*Primary Examiner* — Robert J Sandy
*Assistant Examiner* — Abigail Morrell
(74) *Attorney, Agent, or Firm* — Hickman Palermo Becker Bingham LLP; Daniel D. Ledesma

(57) ABSTRACT

A fabric pin for fixing a fabric on a clothesline comprises a first leg, a second leg and a spring structure. The spring structure is arranged to force the first leg and the second leg in a clamping position in which the fabric is clampable between the first leg and the second leg. The first leg, the second leg, and the spring structure are integrally formed. The spring structure has an outer ring segment portion with a first end and a second end, wherein the first end of the ring segment portion of the spring structure is connected to a distal end region of the first leg and the second end of the ring segment portion of the spring structure is connected to a distal end region of the second leg. The first leg and the second leg are arranged inside the outer ring segment portion of the spring structure.

8 Claims, 5 Drawing Sheets

(56) References Cited

U.S. PATENT DOCUMENTS

| | | | | |
|---|---|---|---|---|
| 2,310,156 | A | | 2/1943 | Van Der Clute |
| 2,442,701 | A | * | 6/1948 | MacDonald ..... 24/557 |
| 2,502,289 | A | * | 3/1950 | Szent-Gyorgyi ..... 24/67.9 |
| 2,910,753 | A | | 11/1959 | Carbauh |
| 5,179,768 | A | | 1/1993 | Jio |

FOREIGN PATENT DOCUMENTS

| | | | |
|---|---|---|---|
| FR | 1183598 | | 7/1959 |
| GB | 1131836 | A * | 10/1968 |
| GB | 2368610 | | 5/2002 |
| WO | WO 2008/122315 | | 10/2008 |

* cited by examiner

FABRIC PIN

CROSS-REFERENCE TO RELATED APPLICATIONS; BENEFIT CLAIM

This application is a U.S. National Stage Application filed under 35 U.S.C. §371 of International Application No. PCT/US11/62818 filed Dec. 1, 2011, which claims priority to U.S. Provisional Patent Application No. 61/421,987 filed Dec. 10, 2010.

FIELD

Embodiments relate to a fabric pin according to the preamble of independent claim 1. Such fabric pins comprising a first leg, a second leg and a spring structure, wherein the spring structure is arranged to force the first leg and the second leg in a clamping position in which the fabric is clampable between the first leg and the second leg and the first leg, the second leg and the spring structure are integrally formed as one piece, can be used for fixing a fabric on a clothesline.

BACKGROUND

For drying or airing fabrics such as clothes and the like it is widespread to hang the fabrics on lines or cords in the fresh air or in a laundry room. Such a hanging provides for an efficient gentle drying with low environmental impact compared to other drying methods such as using a tumble dryer or the like. For fixing the fabrics on the lines and preventing the fabrics from falling off the lines pins or clothespins are commonly used.

Conventional embodiments of such clothespins comprise two legs which are connected to each other at about half their length via a hinged joint. The clothespins further comprise a spring forcing the two legs to tilt such that they are pressed against each other at their first length ends. For fixing a fabric hanging on a clothesline such clothespins are arranged such that the fabric and the clothesline are clamped between the first ends of their legs by a clamping force applied by the spring. For an improved fixing, the first ends of the legs are often provided with gripping means such as small teeth. In order to release the clamping force of such a clothespin, typically the second length ends are pressed towards each other, e.g., by a thumb and an index finger of a hand of a user. Thereby, a force is applied against the spring force of the spring and the legs are tilted in an opposite direction such that the first ends of the legs are moved apart.

Typically, such clothespins consist of three assembled parts, i.e. the two legs and the spring. Thereby, in a manufacturing process such assembling can be a comparably complicated step having an impact on the overall manufacturing efficiency. Also, particularly when being often used, the parts of such clothespins can fall apart. Further, the legs are usually made of wood or a plastic material and the spring is usually made of metal such as steel. Since wood usually is sensitive to weathering and steel corrodes over time particularly when getting wet, such clothespins are often not very durable.

For providing an improved clothespin in terms of manufacturing complexity and durability, e.g., U.S. Pat. No. 5,179,768 A suggests a similar clothespin comprising a first leg, a second leg and a spring structure. The spring structure is arranged to tilt the first leg and the second leg towards each other into a clamping position. In this clamping position a fabric is clampable between first ends of the first and second legs. In contrast to the clothespins mentioned above, the spring structure is shaped as an elastic curved bridge connecting the first and second leg at about have of their length. Thereby, the first leg, the second leg and the curved bridge are integrally formed as one piece, e.g, made of a plastic material.

However, in operation the clothespins of the art normally need to be pressed at the one length side of their legs. In particular, the legs need to be pressed together on their one ends in order that the open at their other ends. This pressing usually is performed by at least two fingers of a hand of the user wherein the user has to hold the according clothespin in the inside of his hand. Thereby, the hand is more or less occupied by operating the clothespin such that the use of the hand for other purposes such as, e.g., holding and positioning a fabric is inhibited. Furthermore, for carrying a plurality of such clothespins, they often are held in the inside of a hand such that the hand is again not free for other purposes.

Therefore, there is a need for a durable efficiently manufacturable fabric pin allowing a convenient operation via a hand of a user with the hand being available for other tasks in the meantime.

SUMMARY

According to embodiments, this need is settled by a fabric pin as it is defined by the features of independent claim 1. Preferred embodiments are subject of the dependent claims.

The gist of embodiments is the following: A fabric pin for fixing a fabric on a clothesline, comprises a first leg, a second leg and a spring structure. The spring structure is arranged to force the first leg and the second leg in a clamping position in which the fabric is clampable between the first leg and the second leg. The first leg, the second leg and the spring structure are integrally formed. The spring structure has an outer ring segment portion with a first end and a second end, wherein the first end of the ring segment portion of the spring structure is connected to a distal end region of the first leg and the second end of the ring segment portion of the spring structure is connected to a distal end region of the second leg. Therein, the first leg and the second leg are arranged inside the outer ring segment portion of the spring structure.

In this context, fabric relates to any textile or non-textile flexible product being hangable on a line or clothesline or the like. In particular, it can relate to washings or laundry such as clothes, linen, towels, curtains, carpets, cloths and the like. The integral forming of the first leg, the second leg and the spring structure relates to an arrangement of the fabric pin as one piece, e.g. a one piece fabric pin. Such a one piece arrangement allows preventing the fabric pin from falling apart such that it can be comparably durable. The first and second ends of the outer ring segment portion particularly are the ends in a circular or circumferential direction. The distal ends of the first and second legs relate to the front ends of the legs being directed towards the fabric when the fabric pin is arranged thereon. Thereby, the distal ends of the first and second legs can be spaced apart such that they form an opening of the fabric pin for receiving the fabric. Starting at their distal ends, the spacing between the two legs can decrease into a proximal direction, i.e. into the direction inside the outer ring segment portion of the spring structure. Inside the outer ring segment portion can particularly relate to being arranged inside the ring or circle described by the outer ring segment portion. In particular, the outer ring segment portion of the spring structure can define the outer boundary of the fabric pin.

In use, firstly a fabric to be fixed can be arranged on the clothesline, e.g., by folding it over the clothesline. Thereafter, it can be fixed by pulling the fabric pin over the fabric and the clothesline by inserting the fabric together with the clothesline through the opening of the fabric pin starting between the distal ends of the first and the second legs. The fabric together with the clothesline can be inserted as far as necessary to be sufficiently clamped between the first and second leg. Thereby, the first and second legs as well as the outer ring segment portion of the spring structure are bent apart such that they provide a clamping force on the fabric and the clothesline. Thus, within this situation the outer ring segment portion provides a primary spring tension on the legs wherein the contact area between the legs and the fabric can be particularly large. This allows the legs to efficiently clamp the fabric wherein they can additionally be provided with a structure for enhancing friction between the legs and the fabric such as, e.g., vertical or horizontal teeth, interlocking vertical or horizontal ribs, an interlocking grid of bumps, barbs or the like.

Such pulling of the fabric pin can be performed by inserting a finger of a hand between the outer ring segment portion of the spring structure and one of the first and second legs and applying a pull force at the fabric pin via the finger which can be performed by a simple downward movement thereof. The rest of the same hand can be kept free for other purposes such as holding the fabric or the like. Furthermore, a plurality of fabric pins can be held on one finger of a hand such that they are located at an outer side of the hand. Thereby, the hand and particularly its inner side can be kept free for other purposes. In particular, this allows holding several fabric pins or clothespins in one hand and in the meantime picking up the fabric, holding and positioning it without dropping either. The held fabric pins can then conveniently be correctly oriented and the fabric can conveniently be fixed. Furthermore, the fabric pin according to the invention allows for efficiently fixing the fabric on the clothesline without providing movable parts besides the comparably small flexion of the legs and the outer ring segment portion of the spring structure. In particular, the fabric pin opens only as much as necessary in order to accommodate and clip or clamp a variety of fabric thicknesses. Thereby, stressing of the fabric pin can be minimized. Also, such a fabric pin can feature a center of gravity that allows it to remain on the clothesline without absorbing moisture and weathering when not in use as well as to provide advantageous aerodynamic properties in order to prevent wind to easily move the fabric pin not in use. Still further, the outer ring segment portion of the spring structure can be a distance holder for several fabrics being arranged on several neighboring clotheslines and fixed by fabric pins according to embodiments.

Preferably, the connection between the first end of the outer ring segment portion of the spring structure and the distal end region of the first leg define a first curved distal surface and the connection between the second end of the outer ring segment portion of the spring structure and the distal end region of the second leg define a second curved distal surface. By means of such curved distal surfaces, the fabric pin can be conveniently placed in a correct position at the fabric on the clothesline. Further, smooth pulling on the fabric can be allowed wherein in the meantime the legs are gently flexed apart.

Preferably, the spring structure has an inner ring segment portion with a first end being connected to a proximal end region of the first leg and a second end being connected to a proximal end region of the second leg. In this context, proximal ends of the legs relate to longitudinal ends being opposed to the distal ends thereof. Such an inner ring segment portion allows for applying additional clamping force on the first and second legs and thereby providing a secondary spring tension. Furthermore, it allows for accommodating the clothesline for storing the fabric pin on the clothesline when no fabric is fixed by the fabric pin. For preventing the inner ring segment portion from unintentionally accommodating a clothesline when clamping a fabric, the fabric pin can have an according blocking structure such as nodes being arranged at the ends of the inner ring segment portion. Thereby, the fabric pin preferably comprises a rib connecting the outer ring segment portion of the spring structure to the inner ring segment portion of the spring structure. Like this, the outer ring segment portion and the inner ring segment portion of the spring structure can be held in a stable position with regard to each other. In particular, the rib can provide for more stability of the fabric clip regarding twisting movements. It also can increase strength of the spring structure and decrease the loss of strength due to changes in temperature in particular if the fabric clip is made of a plastic material.

Preferably, the first leg has a rounded inner side and the second leg has a rounded inner side wherein the inner side of the first leg and the inner side of the second leg are facing each other. In this context, inner sides of the first and second legs relate to the sides of the legs facing each other and particularly being in contact with the fabric when clamping it. Such rounded inner sides can allow for a gentle insertion of the fabric and the clothesline wherein the legs are smoothly flexed apart. In particular, the inner sides can be rounded such that the legs are closest to each other at about half of their lengths.

Preferably, the first leg has an outer side provided with a web and being opposed to the inner side of the first leg and the second leg has an outer side provided with a web and being opposed to the inner side of the second leg. Such webs can provide rigidity to the legs in order to minimize deflection of the legs while clamping. In particular, deformation of the legs due to the forces induced by the spring structure can be reduced. Thereby, the web of the outer side of the first leg preferably broadens into the direction of the distal end region of the first leg and the web of the outer side of the second leg preferably broadens into the direction of the distal end region of the second leg. Like this, variable rigidity can be provided to the legs over their length. In particular, maximum rigidity can be provided at the distal end regions of the legs where the main forces of the spring structure are applied, i.e. the forces provided by the outer ring segment portion of the spring structure.

Preferably, the outer ring segment portion of the spring structure has an outer side provided with a web. In this context, outer side relates to the side of the outer ring segment portion being opposed to the first and second legs. In particular, the outer ring segment portion can comprise a flange wherein at the outer side of which the web rectangularly extends. Such a web can enhance the spring tension of the outer ring segment portion such that a suitable clamping force can be applied by the legs on the fabric. In particular, the spring tension or spring force of the outer ring can conveniently be adjusted according to a planned application of the fabric pin by suitably dimensioning the web. For example, when a fabric pin for applying a comparably high clamping force on a fabric is needed the web can be dimensioned with a comparably large width. Thereby, the web of the outer ring segment portion of the spring structure preferably broadens into the direction of a section of the outer ring segment portion of the spring structure being opposed to the first end of the outer ring segment portion of the spring structure and the second end of the outer ring segment portion of the spring structure.

Such an arrangement of the web of the outer ring segment portion can allow for providing a suitable spring tension and in the meantime for a smooth spreading of the legs in order to accommodate the fabric and the clothesline.

Preferably, the fabric pin is made of a plastic material. Such a fabric pin can be designed to be solid, robust and resistant for ultraviolet light and for rotting, corroding, molding or mildew processes. Furthermore, it can be easy to clean, e.g., with soap and water. Also, such a material allows the fabric pin to be recycled through long established plastics industry grinding down and reclaiming processes such that its impact to the environment can be reduced when being disposed. In addition to the plastic material, the fabric pin or parts thereof such as the legs and/or the outer ring segment portion can comprise a metallic element such as a steel wire or the like. Such a metallic element can increase resistance of the fabric clip, increase the strength of the spring structure and prevent creeping of the fabric pin in particular when being exposed to sunlight. The metallic element can be designed as a metallic core embedded in the plastic material or as a metallic wire attached at least partially along specific sections of the fabric pin. Thereby, the fabric pin preferably is manufactured by injection molding which allows for an efficient precise manufacturing of the fabric pin at comparably low costs.

These and other aspects of the invention will be apparent from and elucidated with reference to the embodiment(s) described hereinafter.

BRIEF DESCRIPTION OF THE DRAWINGS

The fabric pin is described in more detail hereinbelow by way of exemplary embodiments and with reference to the attached drawings, in which.

DETAILED DESCRIPTION

In the following description certain terms are used for reasons of convenience and are not to be interpreted as limiting. The terms "right", "left", "up", "down", "top" and "bottom" refer to directions in the figures. The terminology comprises the explicitly mentioned terms as well as their derivations and terms with a similar meaning.

Figure 1:
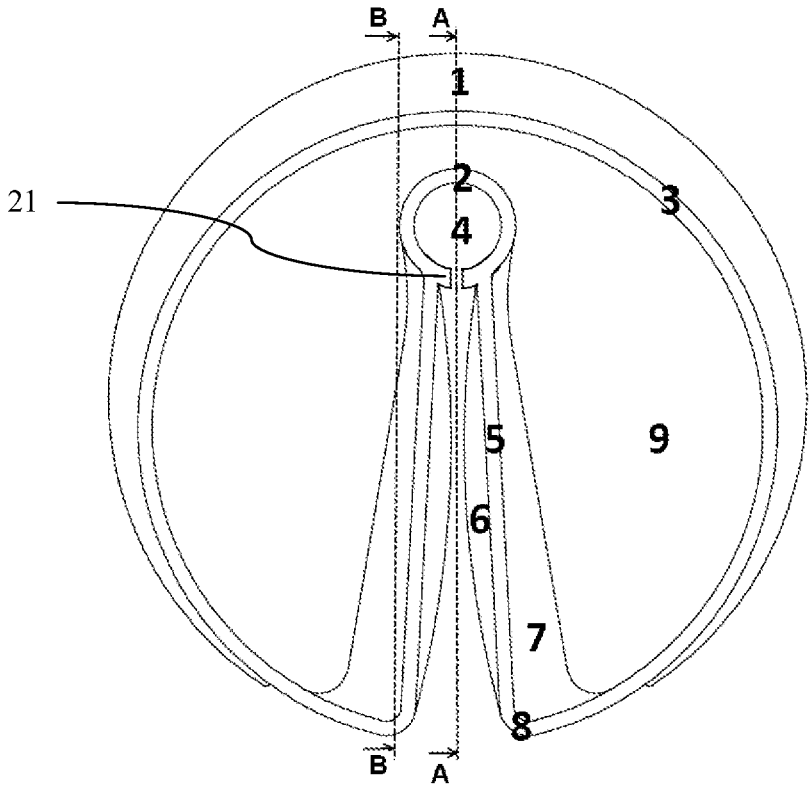
FIG. 1 shows a front view of a first embodiment of a fabric pin according to an embodiment.

FIG. 1 shows a first embodiment of a clothespin as a fabric pin comprising an elongate first leg, an elongate second leg and a spring structure. Each of the first leg and the second leg has a flange portion 5, a curved contact surface 6 as rounded inner side and a web 7 at its outer side. The first and second legs are arranged side by side wherein their curved contact surfaces 6 are facing each other. The spring structure has an outer ring as outer ring segment portion and an inner flange ring 2 as an inner ring segment portion. Each of the inner flange ring and the outer ring has a first end in a circumferential direction and a second end in an opposite circumferential direction. Near the first end and the second end, the inner flange ring 2 is connected to a proximal end of the first leg and to a proximal end of the second leg, respectively. Each of the first and second ends of the inner flange ring 2 projects from the according connection with the first or second leg, respectively, towards the other end of the inner flange ring 2 thereby forming a cornered node 21. The inside of the inner flange ring 2 forms a void 4.

The outer ring has a flange portion 3 and a web 1 provided at an outer side of the flange portion 3. At the first end and the second end of the outer ring the flange portion 3 of the outer ring passes over into a distal end of the first leg and into a distal end of the second leg, respectively. Thereby, at the transition from the first end of the outer ring to the distal end of the associated leg a first curved insert point 8 as first curved distal surface is formed and at the transition from the second end of the outer ring to the distal end of the associated leg a second curved insert point 8 as second curved distal surface. The insert points 8 allow a fabric to smoothly slip into the clothespin. In between the outer ring, the inner flange ring 2 and the legs a finger void 9 is arranged allowing multiple further corresponding clothespins to be held on one or multiple fingers during application or removal of the clothespin.

The webs 7 of the first leg and the second leg extend between the proximal ends and the distal ends thereof. Thereby, they linearly broaden into the direction of the distal ends such that they are narrowest at the proximal ends and broadest at the distal ends. The webs 7 of the first leg and the second leg provide rigidity for compression while a spring tension acts on the two legs in order to apply a clamping force by the two legs. The web 1 of the outer ring extends from near the first end and near the second end of the outer ring to a section of the outer ring opposed to the first end and the second end of the outer ring, i.e. the upper end of the outer ring. Thereby, the web 1 continuously broadens such that its broadest section is at the upper end of the outer ring. The web 1 of the outer ring together with its flange portion 2 provides a primary spring tension onto the first and second leg while these are spread apart. By shaping the web 1 diminishing from top to bottom, the primary spring tension can functionally be applied to the first and second legs such that the primary spring tension increases the more the first and second legs are spread apart.

The following applies to the rest of this description. If, in order to clarify the drawings, a figure contains reference signs which are not explained in the directly associated part of the description, then it is referred to previous sections of the description.

Figure 2:
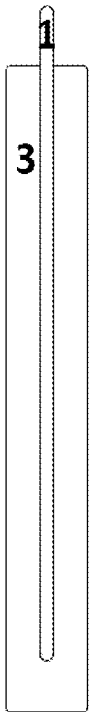
FIG. 2 shows a side view of the fabric pin from FIG. 1.

In FIG. 2 a side view of the clothespin is shown in which the flange portion 3 and the web 1 of the outer ring are visible. The flange portion 3 is wider than the web 1 such that it projects above the web 1 to the left and to the right. The web 1 does not extend all over the flange portion 3 but only up to near the bottom of it. Thus, the flange portion 3 has a bottom section without the web 1 which passes over into one of the curved insert points 8.

Figure 3:
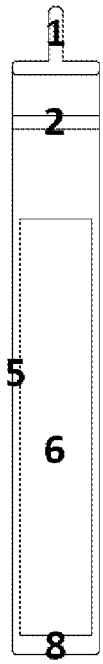
FIG. 3 shows a sectional view along the line A-A from FIG. 1.

FIG. 3 shows an inner side of one leg of the first and second legs of the clothespin in more detail. The flange portion 5 of the one leg extends from its upper proximal end at which the one leg passes over into the inner flange ring 2 up to its lower distal end at which the one leg passes over in the associated insert point 8. Onto the flange portion 5 the curved contact surface 6 of the one leg is arranged extending from its upper proximal end up to near its lower distal end. The flange portion 5 has a width which is slightly greater than the width of the curved contact surface 6 such that the flange portion 5 slightly projects above the curved contact surface 6 to the left and to the right.

Figure 4:
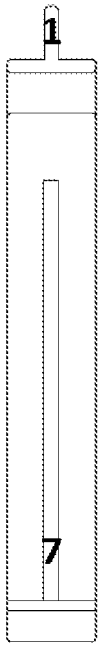
FIG. 4 shows a sectional view along the line B-B from FIG. 1.

In FIG. 4 an outer side of the one of the first and second legs of the clothespin is shown in more detail. From top to bottom, the web 1 passes into the flange portion of the outer ring. Below, the inner flange ring is arranged passing over into the one of the first and second legs which extends from the beginning of its web 7 to the bottom of the clothespin or its corresponding one of the curved insert points 8.

For applying the clothespin in order to fix a fabric being folded over a clothesline, the clothespin is placed with its curved insert points 8 onto the fabric. Then, the clothespin is pulled downwardly such that the fabric and the clothesline are inserted between and clamped by the first and second legs. Within such pulling movement, the first and second legs are at least temporarily spread apart wherein the outer ring provides a primary spring tension or primary spring force and the inner flange ring 2 provides a secondary spring tension or secondary spring force on the first and second legs such that the first and second legs provide a clamping force onto the fabric. Thereby, the nodes 21 of the inner flange ring 2 prevent unintentional arrangement of the clothesline inside the void 4 of the inner flange ring 2 which would decrease clamping force applied by the first and second legs. The curved contact surfaces 6 of the first and second legs provide a smooth compression or clamping surface to the fabric.

Figure 5:
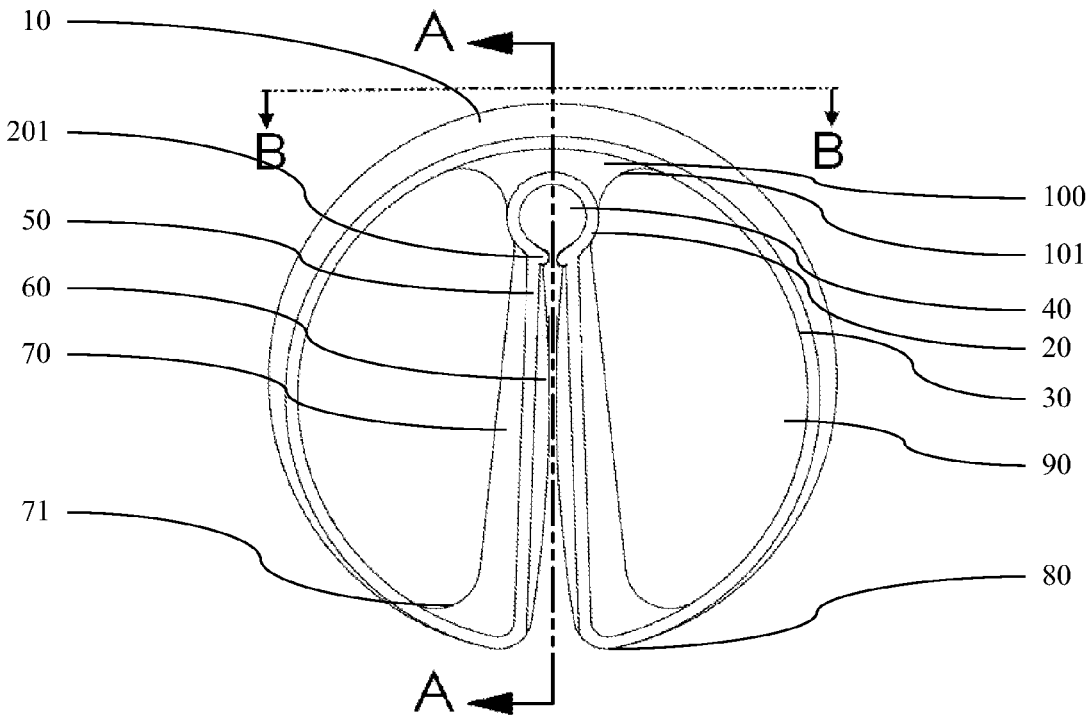
FIG. 5 shows a front view of a second embodiment of a fabric pin according to an embodiment.
Figure 6:
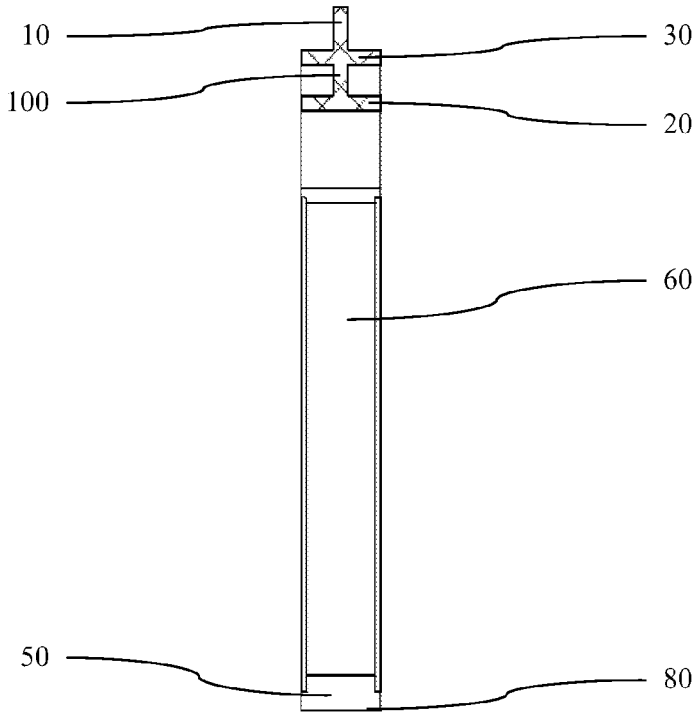
FIG. 6 shows a sectional view along the line A-A from FIG. 5.
Figure 7:
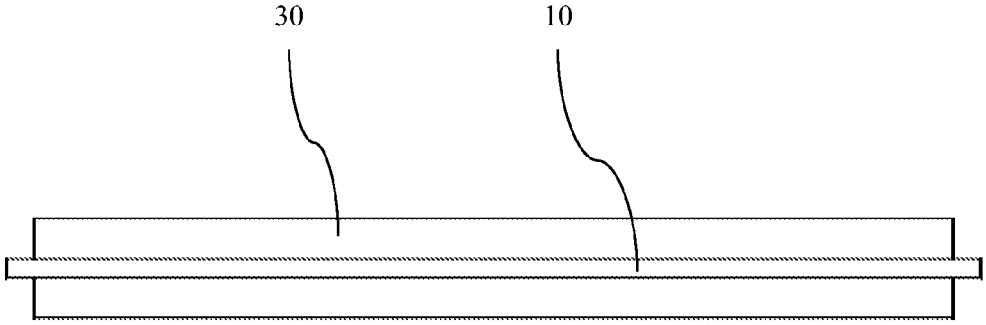
FIG. 7 shows a side view along the line B-B from FIG. 5
Figure 8:
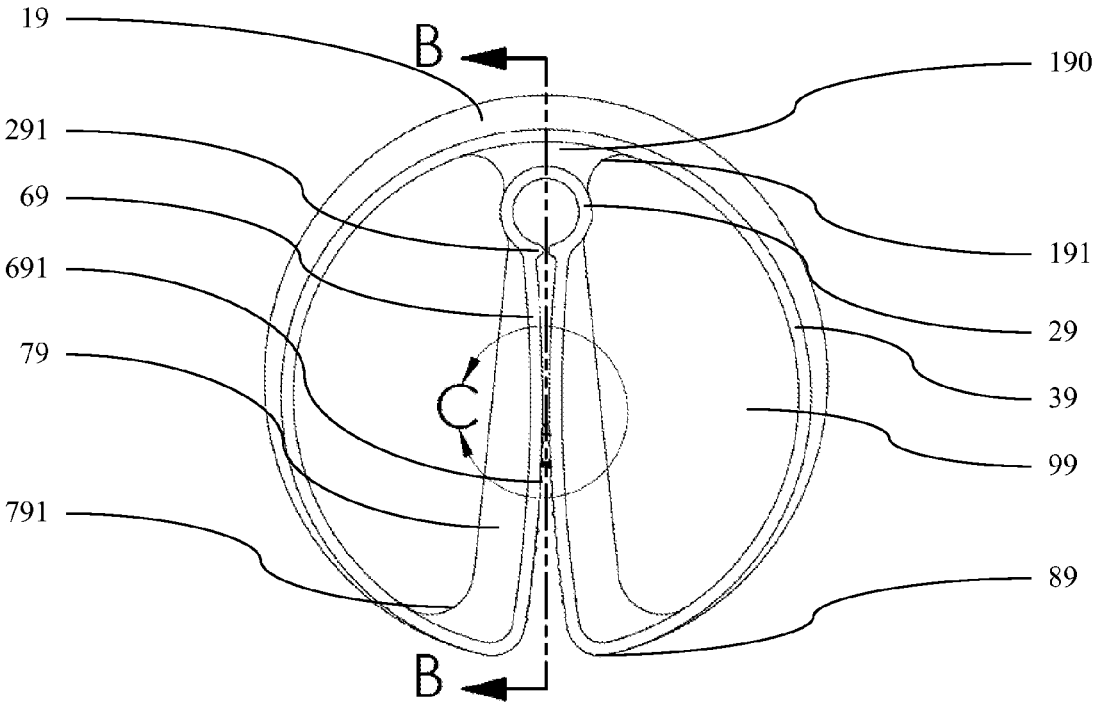
FIG. 8 shows a front view of a third embodiment of a fabric pin according to an embodiment.
Figure 9:
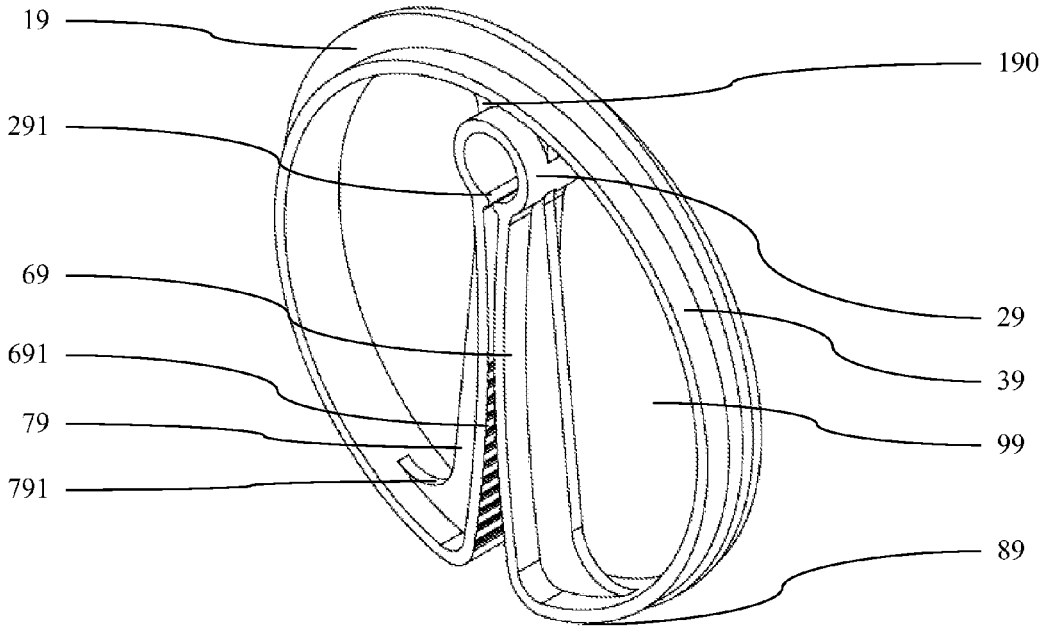
FIG. 9 shows a perspective view of the fabric pin from FIG. 8.

FIG. 5, FIG. 6 and FIG. 7 show a second embodiment of a clothespin as a fabric pin which generally is of a similar design as the clothespin shown in FIGS. 1 to 4. Thereby, it comprises an elongate first leg, an elongate second leg and a spring structure. Each of the first leg and the second leg has a flange portion 50, a curved contact surface 60 as rounded inner side and a web 70 at its outer side. The first and second legs are arranged side by side wherein their curved contact surfaces 60 are facing each other.

The spring structure has an outer ring with an outer diameter of about 8.1 centimeters (3.188 inches) as outer ring segment portion and an inner flange ring 20 with an inner diameter of about 1 centimeter (0.375 inches), a thickness of about 0.2 centimeters (0.07 inches) and a width of about 1 centimeters (0.375 inches) as an inner ring segment portion. Each of the inner flange ring 20 and the outer ring has a first end in a circumferential direction and a second end in an opposite circumferential direction. Near the first end and the second end, the inner flange ring 20 is connected to a proximal end of the first leg and to a proximal end of the second leg, respectively. Each of the first and second ends of the inner flange ring 20 projects from the according connection with the first or second leg, respectively, towards the other end of the inner flange ring 20 thereby forming a rounded node 201. The inside of the inner flange ring 20 forms a clothesline storage void 40. The rounded shape of the nodes 201 of the inner flange ring 20 allows a user to exert a bit of pressure and snap an empty fabric pin onto a clothesline such that it is arranged inside the clothesline storage void 40, as well as out of it.

The outer ring has a flange portion 30 with a width of about 1 centimeter (0.375 inches), an outer diameter of about 7.6 centimeters (3 inches) and a thickness of about 0.2 centimeters (0.7 inches) as well as a web 10 with a thickness of about 0.2 centimeters provided at an outer side of the flange portion 30. At the first end and the second end of the outer ring the flange portion 30 of the outer ring passes over into a distal end of the first leg and into a distal end of the second leg, respectively. Thereby, at the transition from the first end of the outer ring to the distal end of the associated leg a first curved insert point 80 as first curved distal surface is formed and at the transition from the second end of the outer ring to the distal end of the associated leg a second curved insert point 80 as second curved distal surface. The insert points 80 allow a fabric to smoothly slip into the clothespin. In between the outer ring, the inner flange ring 20 and the legs a finger void 90 is arranged allowing multiple further corresponding clothespins to be held on one or multiple fingers during application or removal of the clothespin.

The webs 70 of the first leg and the second leg extend between the proximal ends and the distal ends thereof. Thereby, they linearly broaden into the direction of the distal ends such that they are narrowest at the proximal ends and broadest at the distal ends. The webs 70 of the first leg and the second leg provide rigidity for compression while a spring tension acts on the two legs in order to apply a clamping force by the two legs. At the lower end of the finger void each of the webs 70 of the first leg and the second leg have a smoothened radius 71 of about 0.6 centimeters (0.250 inches). These smoothened radiuses 71 allow for a comfortable pulling of the clothespin onto a fabric by a finger of a user being arranged inside the finger void 90.

The web 10 of the outer ring extends from near the first end and near the second end of the outer ring to a section of the outer ring opposed to the first end and the second end of the outer ring, i.e. the upper end of the outer ring. Thereby, the web 10 continuously broadens such that its broadest section having a maximum width of about 0.5 centimeters (0.191 inches) is at the upper end of the outer ring. The web 10 of the outer ring together with its flange portion 20 provides a primary spring tension onto the first and second leg while these are spread apart. By shaping the web 10 diminishing from top to bottom, the primary spring tension can functionally be applied to the first and second legs such that the primary spring tension increases the more the first and second legs are spread apart.

In between the upper end of the outer ring or the broadest section of its web 10 and the flange ring 20 a rib 100 having a thickness of about 0.2 centimeters (0.7 inches) is arranged. The rib 100 broadens from the flange ring 20 to the outer ring such that its broadest section is at its connection to the outer ring or at its upper end. The rib 100 provides stability with regard to twisting movements of the clothespin. It further increases the strength of the spring structure. Towards the finger void 90 the rib 100 has smoothened radius 101 of about 0.6 centimeters (0.250 inches). These smoothened radiuses 101 allow for a comfortable pulling of the clothespin from a fabric and a clothesline away by a finger of a user being arranged inside the finger void 90.

FIG. 8, FIG. 9, FIG. 10 and FIG. 11 show a third embodiment of a clothespin as a fabric pin which generally is of a similar design as the clothespin shown in FIGS. 1 to 4 and the clothespin shown in FIGS. 5 to 7. Thereby, it comprises an elongate first leg, an elongate second leg and a spring structure. Each of the first leg and the second leg has a bent flange portion 69 with a curved contact surface as rounded inner side and a web 79 at its outer side. About one half of the curved contact surface of the flange portion 69 of each of the first and second legs is provided with essentially horizontal teeth 691 as a structure for enhancing friction between the first and second legs and a fabric. The first and second legs are arranged side by side wherein the curved contact surfaces of the bent flange portions 69 are facing each other. The spring structure has an outer ring as outer ring segment portion and an inner flange ring 29 as an inner ring segment portion. Each of the inner flange ring 29 and the outer ring has a first end in a circumferential direction and a second end in an opposite circumferential direction. Near the first end and the second end, the inner flange ring 29 is connected to a proximal end of the first leg and to a proximal end of the second leg, respectively. Each of the first and second ends of the inner flange ring 29 projects from the according connection with the first or second leg, respectively, towards the other end of the inner flange ring 29 thereby forming a rounded node 291. The inside of the inner flange ring 29 forms a clothesline storage void 49. The rounded shape of the nodes 291 of the inner flange ring 29 allows a user to exert a bit of pressure and snap an empty fabric pin onto a clothesline such that it is arranged inside the clothesline storage void 49, as well as out of it.

The outer ring has a flange portion 39 as well as a web 19 provided at an outer side of the flange portion 39. At the first end and the second end of the outer ring the flange portion 39 of the outer ring passes over into a distal end of the first leg and into a distal end of the second leg, respectively. Thereby, at the transition from the first end of the outer ring to the distal end of the associated leg a first curved insert point 89 as first curved distal surface is formed and at the transition from the second end of the outer ring to the distal end of the associated leg a second curved insert point 89 as second curved distal surface. The insert points 89 allow a fabric to smoothly slip into the clothespin. In between the outer ring, the inner flange ring 29 and the legs a finger void 99 is arranged allowing multiple further corresponding clothespins to be held on one or multiple fingers during application or removal of the clothespin.

The webs 79 of the first leg and the second leg extend between the proximal ends and the distal ends thereof. Thereby, they continuously broaden into the direction of the distal ends such that they are narrowest at the proximal ends and broadest at the distal ends. The webs 79 of the first leg and the second leg provide rigidity for compression while a spring tension acts on the two legs in order to apply a clamping force by the two legs. At the lower end of the finger void each of the webs 79 of the first leg and the second leg has a smoothened radius 791. These smoothened radiuses 791 allow for a comfortable pulling of the clothespin onto a fabric by a finger of a user being arranged inside the finger void 99.

The web 19 of the outer ring extends from near the first end and near the second end of the outer ring to a section of the outer ring opposed to the first end and the second end of the outer ring, i.e. the upper end of the outer ring. Thereby, the web 19 continuously broadens such that its broadest section is at the upper end of the outer ring. The web 19 of the outer ring together with its flange portion 29 provides a primary spring tension onto the first and second leg while these are spread apart. By shaping the web 19 diminishing from top to bottom, the primary spring tension can functionally be applied to the first and second legs such that the primary spring tension increases the more the first and second legs are spread apart.

In between the upper end of the outer ring or the broadest section of its web 19 and the flange ring 29 a rib 190 is arranged. The rib 190 broadens from the flange ring 29 to the outer ring such that its broadest section is at its connection to the outer ring or at its upper end. The rib 190 provides stability with regard to twisting movements of the clothespin. It further increases the strength of the spring structure. Towards the finger void 99 the rib 190 has smoothened radius 191. These smoothened radiuses 191 allow for a comfortable pulling of the clothespin from a fabric and a clothesline away by a finger of a user being arranged inside the finger void 99.

Figure 10:
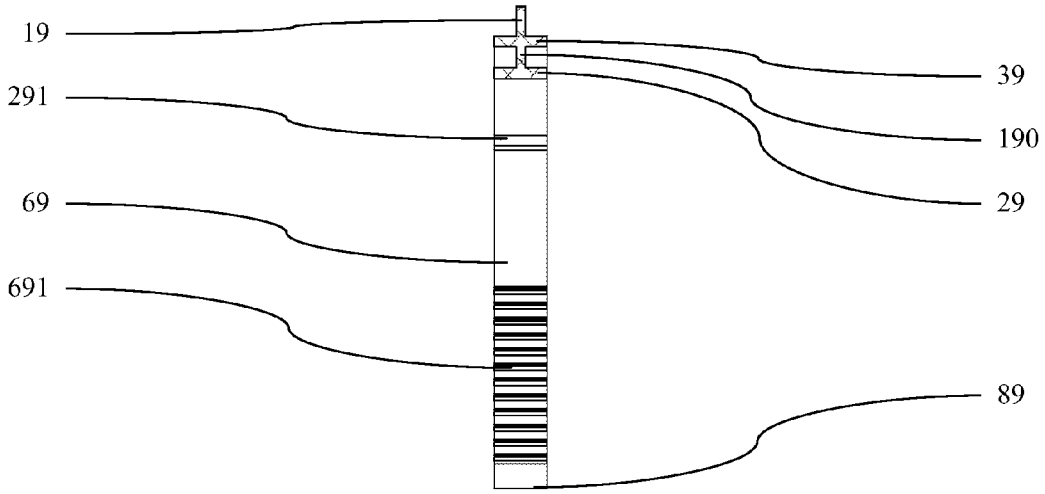
FIG. 10 shows a sectional view along the line B-B from FIG. 8.
Figure 11:
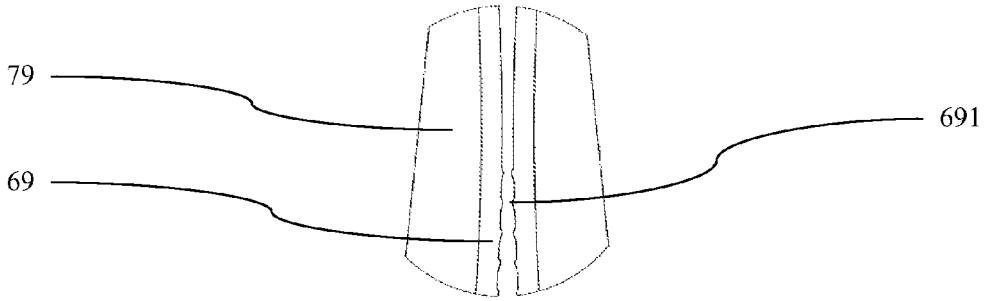
FIG. 11 shows a front view of detail C from FIG. 8.

Compared to the clothespin shown in the FIGS. 5 to 7 of the clothespin of FIGS. 8 to 11 particularly differs in the design of the first and second legs. Thereby, as can be seen in FIG. 10, the flange portion 69 of each of the first and second legs towards a distal end region of the respective leg is provided with the teeth 691. As can particularly be seen in FIG. 11, the shape of the teeth 691 is designed to enhance the friction between the clothespin and a fabric in order to improve clamping without harming the fabric. As can particularly be seen in FIGS. 8 and 9, the flange portion 69 of each of the first and second legs is bent which can improve the fabric clamping procedure.

While embodiments have been illustrated and described in detail in the drawings and foregoing description, such illustration and description are to be considered illustrative or exemplary and not restrictive. It will be understood that changes and modifications may be made by those of ordinary skill within the scope and spirit of the following claims. In particular, an embodiment covers further embodiments with any combination of features from different embodiments described above and below. For example, it is possible to operate an embodiment wherein the fabric pin can be used for other purposes than for clipping a fabric or, particularly, for fixing a fabric on a clothesline. Or as another example, the measures of the second embodiment of the clothespin described above can also be implemented within the first embodiment of the clothespin described above or to the fabric pin defined in the claims.

Embodiments also cover all further features shown in the Figs, individually although they may not have been described in the afore or following description. Also, single alternatives of the embodiments described in the figures and the description and single alternatives of features thereof can be disclaimed from the subject matter.

Furthermore, in the claims the word "comprising" does not exclude other elements or steps, and the indefinite article "a" or "an" does not exclude a plurality. A single unit may fulfill the functions of several features recited in the claims. The terms "essentially", "about", "approximately" and the like in connection with an attribute or a value particularly also define exactly the attribute or exactly the value, respectively. Any reference signs in the claims should not be construed as limiting the scope.

The invention claimed is:

1. A fabric pin for fixing a fabric on a clothesline, comprising a first leg, a second leg and a spring structure, wherein the spring structure is arranged to force the first leg and the second leg in a clamping position in which the fabric is clampable between the first leg and the second leg, wherein the first leg, the second leg and the spring structure are integrally formed, wherein the spring structure has an outer ring segment portion with a first end and a second end, wherein the first end of the outer ring segment portion of the spring structure is connected to a distal end region of the first leg and the second end of the outer ring segment portion of the spring structure is connected to a distal end region of the second leg, and wherein the first leg and the second leg are arranged inside the outer ring segment portion of the spring structure, wherein the spring structure has an inner ring segment portion with a first end being connected to a proximal end region of the first leg and a second end being connected to a proximal end region of the second leg, further comprising a rib connecting the outer ring segment portion of the spring structure to the inner ring segment portion of the spring structure, wherein the rib broadens from the inner ring segment portion to the outer ring segment portion such that its broadest section is at its connection to the outer ring segment portion.

2. The fabric pin according to claim 1, wherein the connection between the first end of the outer ring segment portion of the spring structure and the distal end region of the first leg define a first curved distal surface and the connection between the second end of the outer ring segment portion of the spring structure and the distal end region of the second leg define a second curved distal surface.

3. The fabric pin according to claim 1, wherein the first leg has a rounded inner side and the second leg has a rounded inner side wherein the rounded inner side of the first leg and the rounded inner side of the second leg are facing each other.

4. The fabric pin according to claim 1, wherein the first leg has an outer side provided with a web and being opposed to an inner side of the first leg and the second leg has an outer side provided with a web and being opposed to an inner side of the second leg.

5. The fabric pin according to claim 4, wherein the web of the outer side of the first leg broadens into the direction of the distal end region of the first leg and the web of the outer side of the second leg broadens into the direction of the distal end region of the second leg.

6. The fabric pin according to claim 1, wherein the outer ring segment portion of the spring structure has an outer side provided with a web.

7. The fabric pin according to claim 6, wherein the web of the outer ring segment portion of the spring structure broadens into the direction of a section of the outer ring segment portion of the spring structure being opposed to the first end of the outer ring segment portion of the spring structure and the second end of the outer ring segment portion of the spring structure.

8. The fabric pin according to claim 1, wherein the fabric pin is made of a plastic material.

* * * * *